US005279338A

United States Patent [19]

Goossens

[11] Patent Number: 5,279,338

[45] Date of Patent: Jan. 18, 1994

[54] MODULAR BUBBLER CONTAINER AUTOMATIC REFILL SYSTEM

[75] Inventor: Dirk Goossens, St. Niklass, Belgium

[73] Assignee: Olin Hunt Specialty Products, Inc., Cheshire, Conn.

[21] Appl. No.: 876,735

[22] Filed: Apr. 27, 1992

Related U.S. Application Data

[63] Continuation-in-part of Ser. No. 589,961, Sep. 28, 1990, abandoned.

[51] Int. Cl.[5] ..... B65B 1/30; B65B 3/26

[52] U.S. Cl. ..... 141/95; 141/82; 141/83; 141/198; 364/500

[58] Field of Search ..... 141/82, 83, 94, 95, 141/192, 198; 364/500, 509, 510, 558, 131, 133; 137/386; 222/64, 65, 400.7; 62/3.3

[56] References Cited

U.S. PATENT DOCUMENTS

| | | | |
|---|---|---|---|
| 3,605,824 | 9/1971 | Madden et al. | 141/1 |
| 3,812,890 | 5/1974 | Haas et al. | 141/94 |
| 4,121,633 | 10/1978 | Diez | 141/69 |
| 4,235,829 | 11/1980 | Partus | 261/121.1 |
| 4,298,037 | 11/1981 | Schumacher et al. | 141/1 |
| 4,393,013 | 7/1983 | McMenamin | 261/64 B |
| 4,408,640 | 10/1983 | Voza | 141/1 |
| 4,436,674 | 3/1984 | McMenamin | 261/64 B |
| 4,467,844 | 8/1984 | Di Gianfilippo et al. | 141/1 |
| 4,487,619 | 12/1984 | Jones | 62/3.3 |
| 4,545,801 | 10/1985 | Miyajiri et al. | 137/211 |
| 4,582,480 | 4/1986 | Lynch et al. | 432/1 |
| 4,598,742 | 7/1986 | Taylor | 141/95 |
| 4,612,772 | 9/1986 | Jones | 62/3.3 |
| 4,676,404 | 6/1987 | Yamazaki et al. | 137/208 |
| 4,713,552 | 12/1987 | Denis et al. | 250/577 |
| 4,979,545 | 12/1990 | Fair | 141/83 |
| 5,038,840 | 8/1991 | Fair | 141/83 |

FOREIGN PATENT DOCUMENTS

| | | | |
|---|---|---|---|
| 0123111 | 7/1983 | Japan | 137/386 |

*Primary Examiner*—Henry J. Recla
*Assistant Examiner*—Steven O. Douglas
*Attorney, Agent, or Firm*—William A. Simons; Ralph D'Alessandro

[57] ABSTRACT

A modular automatic refill system using a plurality of individual microprocessor controlled modules to control a plurality of liquid chemical temperature controllers is provided wherein replenishing liquid chemical is automatically supplied from a chemical bulk supply unit to a plurality of bubbler ampules in the corresponding liquid chemical temperature controllers based on sensed level depths in a manner that avoids contamination of the replenishing chemical and permits separate and independent operation of the individual microprocessor controlled modules.

3 Claims, 5 Drawing Sheets

MODULAR BUBBLER CONTAINER AUTOMATIC REFILL SYSTEM

This application is a continuation-in-part of U.S. Ser. No. 07/589,961 filed on Sep. 28, 1990 now abandoned.

BACKGROUND OF THE INVENTION

This invention relates generally to a system to automatically refill a liquid from a bulk container to a smaller receiving container without contamination. More specifically, it relates to a modular system providing fresh liquid chemicals through an automatic refill to a plurality of bubbler ampules in their corresponding liquid source temperature controllers that supply a vapor to a corresponding number of diffusion furnaces.

Source liquid chemical temperature controllers have been utilized in the semiconductor and fiber optics industries to supply chemicals directly or in carrier gases that are saturated with the particular chemical as a function of the ampule's or liquid chemical receiving container's, temperature. Various ultra high purity liquid chemicals, including those commonly called dopants, are required for these industries.

The ampules in liquid temperature controllers, commonly called bubblers, must be periodically replaced based on the usage of the ultra high purity source chemical. The amount of chemical used is a function of the degree of saturation of the carrier gas carrying the chemical to the diffusion furnace and the quantity of carrier gas used. This, in turn, is a direct function of the bubbler ampule temperature. Typical inert carrier gases are nitrogen, argon, or helium. Some typical chemicals utilized in bubblers are licate 1,1-trichloroethane (TCA), tetraethylorthosilicate (TEOS), phosphorous oxychloride ($POCl_3$), and the dopant chemicals trimethylborate and trimethylphosphite.

In the past, when the chemical in the bubbler ampule was depleted, typically the ampule had to be removed from the temperature controller and refilled at a remote site. An attempt to create a commercial system to refill the ampules within the temperature controller was developed by the J. C. Schumacher Company and called the CRS chemical refill system. This system refills empty quartz bubbler ampules batchwise in the temperature controllers.

In the typical semicondutor prior art process, a replacement bubbler ampule, with fresh chemical, is inserted into the liquid temperature controller. This replacement of the chemical, however, requires physical removal of the depleted ampule from the liquid temperature controller and suffers from the inability to operate both the diffusion furnace and the liquid temperature controller for a period of time. The temperature of the replacement liquid chemical is lower than that required for operation by this prior art replacement procedure. Normally the furnace tube temperature is then lowered during these periods of non-operation. Prior to recommencing use of the replenished chemicals, both the bubbler ampule and the diffusion furnace have to be reheated to their operating temperatures. Further, test samples are routinely run through the process to ensure that the replenished chemical is not contaminated prior to resuming the production operation. The total liquid chemical replacement process can take from two to eight hours, depending upon the chemical involved and the end use.

In the prior art Schumacher chemical refill system, the same problem was present with the low temperature of the replacement chemical and resultant inability to operate the diffusion furnace until the chemical was reheated. This system had the additional disadvantage of being oversized for use in clean rooms.

Automatic liquid replacement or refill systems for liquids have been utilized in other industries, but where the purity requirements of the liquid are far less stringent. Generally, however, these replacement systems have been based upon measuring the weight of the liquid in the receiving container at comparative points in time or by using a time filling sequence to ensure the proper volumetric quantity is delivered. None of the systems were designed to work with the stringent requirements needed for ultra high purity chemicals in the semiconductor industry.

Additionally, automatic chemical refill systems servicing a multiple number of temperature controllers and their bubbler ampules from one central refill control system have suffered from the problem that when one temperature controller has experienced problems or malfunctioned in the system, all of the refill lines have had to be shutdown until the problem is corrected. Most chemical vapor deposition systems are capable of operating up to four temperature controllers concurrently to supply vapors to a corresponding number of diffusion furnaces. Thus, a repair required of just one temperature controller in the refill system can cause all of the temperature controllers in the system to be shutdown.

These problems are solved in the design of the present refill system by providing a Modular automatic refill system where the temperature controllers operate completely independently from each other to automatically refill the bubbler ampule in a liquid temperature controller without removing the ampule from the controller.

SUMMARY OF THE INVENTION

It is an object Of the present invention to provide a modular automatic refill system for an ultra high purity chemical.

It is another object of the present invention to provide an automatic refill system for an ultra high purity chemical that obviates the need to remove the receiving container from the working apparatus.

It is a feature of the present invention that the system controls the plurality Of chemical receiving containers independently on one another.

It is another feature of the present invention that the automatic refill system has separate control modules for each temperature source controller which may be removed from the automatic refill system during operation of the remaining modules without damaging or harming the microprocessor of the removed module.

It is another feature of the present invention that every digital input/output is galvanically isolated from the microprocessor.

It is still another feature of the present invention that the automatic refill system can be utilized to fill more than one liquid-receiving receptacle with the ultra high purity chemical from a single bulk container.

It is a further feature of the present invention that the temperature of the liquid chemical in the chemical receiving ampule does not change significantly during replenishment and that the level change of the liquid chemical is minimized.

It is still a further feature of the present invention that the degree of saturation of the carrier gas by the liquid chemical replenished by the automatic refill system does not change.

It is yet another feature of the present invention that each of the modules are separate, stand-alone units with their own microprocessor and peripheral electronics.

It is an advantage of the present invention that when one module controlling one temperature controller malfunctions, the remaining modules and temperature controllers continue to work normally.

It is another advantage of the present invention that the replacement of a malfunctioning module or temperature controller does not interfere with the operation of the remaining modules, temperature controllers, and their associated diffusion furnaces.

It is still another advantage of the present invention that the separate modules are quickly and easily replaced since they are designed as pull out/plug in units.

It is still another advantage of the present invention that the modular automatic refill system does not upset the temperature of the liquid chemical in the receiving ampule and, therefore, the saturation level of the exiting gas is not significantly disturbed.

It is still another advantage of the present invention that the modular automatic refill system is very flexible and permits connection and control of any desired number of temperature controllers by adjusting the number of modules in the modularly expandable automatic refill system.

It is yet another advantage of the present invention that there is no need to remove the ultra high purity chemical liquid-receiving ampules from the liquid temperature controllers in the system to refill them with the chemical, nor is there a necessity to install new ampules in their place so that the operation of the corresponding diffusion furnaces are not affected during the automatic refilling operation.

These and other objects, features and advantages are obtained by a modular automatic chemical refill system which permits fast and easy replacement of damaged or malfunctioning modules within the automatic refill system without affecting the operation of the remaining modules so that any of a plurality of temperature controllers in the system can continue to operate and supply chemical from the ampules to the corresponding diffusion furnaces without interruption. The modular automatic refill system senses the level of liquid chemical in each bubbler ampule and automatically refills the liquid chemical in the bubbler ampules to an operating level without requiring removal of the ampules from their corresponding liquid temperature controller or without significantly affecting the temperature and the saturation level of the carrier gas with the liquid chemical.

DETAILED DESCRIPTION OF THE PREFERRED EMBODIMENT

Figure 1:
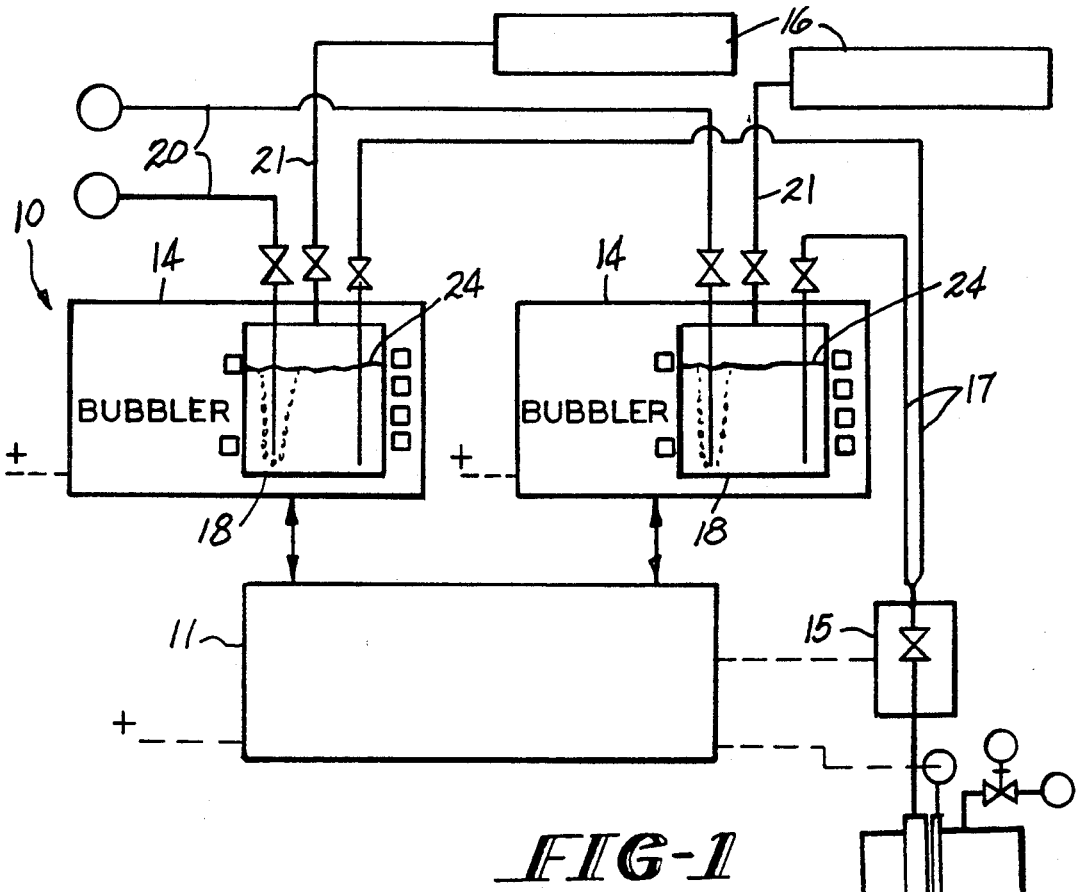
FIG. 1 is a diagrammatic illustration of the modular automatic refill system utilizing a liquid temperature controller, a bulk container for the liquid chemical.

FIG. 1 is a diagrammatic illustration of a modular automatic refill system for providing an ultra high purity chemical from a bulk supply chemical container to a working container as a part of a larger working apparatus. This system, indicated generally by the numeral 10, will be described in terms of a liquid temperature controller, indicated generally by the numeral 14, that operates within the system. The level and temperature of the liquid in ampule 18 is controlled by a modular automatic refill system controller 11 that has separate microprocessor controlled unit modules 91 (See FIG. 8) which control the replenishment of chemical from a bulk supply chemical container or tank 12 to an individual ampule 18 in a temperature controller 14 as part of a system of multiple temperature controllers and diffusion furnaces. Where multiple liquid temperature controllers 14 have their ampules 18 refilled from the single bulk supply chemical container 12, the separate controlled unit modules 91 of the modular automatic refill system controller 11 are programmed to control the refilling operation of a specific temperature controller 14 and corresponding ampule 18.

In response to sensings from the controller 14 of the liquid level within ampule or working container 18, the microprocessor controlled unit module 91 calls for refill of the chemical from the bulk container 12 by actuator means, such as solenoid valves on valve control manifold 15, to move the valves between open and closed positions.

Figure 2:
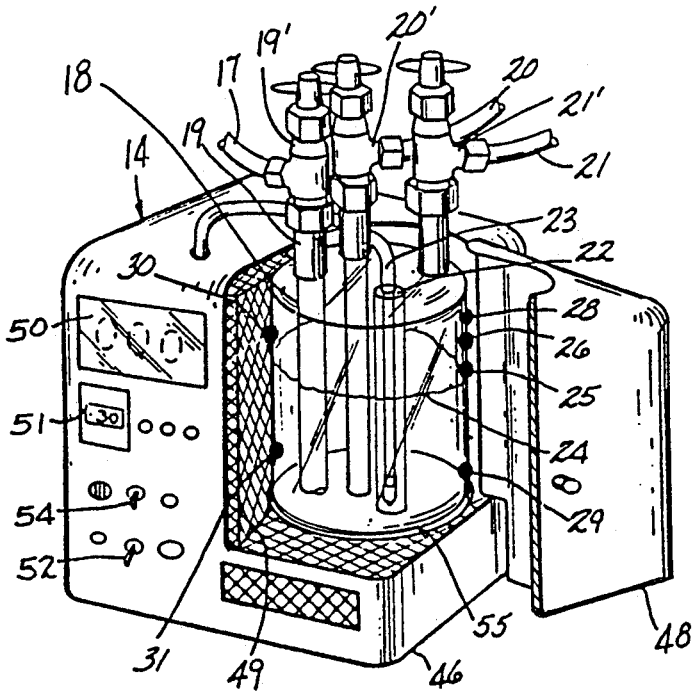
FIG. 2 is a diagrammatic illustration of an exemplary liquid temperature controller showing the liquid chemical receiving ampule.

As seen in FIG. 2, the liquid temperature controller 14 is a standard commercially available controller, such as that sold by Olin Hunt Specialty Products, Incorporated as the Model 775 or the Model 875. The ampule 18 is placed within the controller 14 and is shown, for example, having an automatic refill line 19 through which the replacement chemical is added via chemical process infeed line 17, an inert carrier gas process infeed line 20, a vapor outlet line 21, a thermowell 22 filled with oil (not shown) and a temperature sensing unit 23 for sensing temperatures of the chemical within the ampule 18. The automatic refill line 19 is seen extending down into the ampule and below the gas-liquid chemical interface level 24 to a position adjacent the bottom of the ampule. The gas-liquid interface 24 is shown as being somewhere between the top and the bottom of the ampule. Couplings and shutoff valves, indicated generally by the numerals 19', 20', and 21' connect lines 17, 20 and 21 to the ampule 18.

A representative liquid temperature controller 14 has a housing 46 with a hinged door 48 to permit access to the ampule 18. An insulating and cushioning material 49 fills the space surrounding the sides of the ampule 18, with appropriate openings for the sensor means to be described hereafter. A liquid temperature readout 50 and a temperature set point 51, along with a controller power switch 52 and alarm set switch 54 are provided on the front of the housing 46. An ampule heating means and heat sink 55 controls the temperature of the liquid chemical within the controller 14.

Where a quartz ampule is used, sensor means are provided within the temperature controller 14 to sense the level of the liquid chemical and to automatically refill the ampule 18 to attempt to achieve the minimum change possible in the level of liquid chemical. This ensures that the temperature of the chemical is not substantially disturbed when refilled with the chemical at room temperature from the bulk container 12 and that the degree of saturation of the carrier gas with the chemical is not significantly altered. The sensor means include an automatic fill start point chemical level sensor means 25 and an automatic fill stop point chemical level sensor means 26, both of which are preferably about one centimeter apart in vertical height. The temperature controller 14 also has a chemical level overfill automatic shutoff point sensor means 28 in the event that the liquid level exceeds the level of the stop point chemical level of sensor means 26. A programmable maximum refill time is an extra safety feature in the software of the microprocessor controlled unit module 91 (see FIG. 8 briefly). A low level sensor means 29 can make an emergency call for resupply of chemical from the bulk supply chemical container 12 and initiates a signal by an appropriate alarm, such as visual or audial, from the appropriate microprocessor 76 of FIG. 6 and module 91 should the chemical level drop to an unacceptably low level in the ampule 18 that could cause an interruption of operation if not corrected.

One suitable technique of sensing the liquid chemical level employs the use of sensor means 25, 26 and 28 which work in conjunction with a light source or infrared emitter 30, such as a light emitting diode, that is positioned oppositely in the wall of the controller 14 from the sensor means 25, 26 and 28. Sensor means 25, 26 and 28 can be appropriate commercially available photoreceptors or photodarlingtons, depending upon the sensitivity required.

Low level sensor means 29 also can be a commercially available photoreceptor or photodarlington that works in conjunction with a light source or infrared emitter 31 near the bottom of the ampule 18 to detect when the chemical is at a dangerously low level. Sensor means 29 can also be employed in conjunction with additional photoreceptors to detect, for example, when the chemical level is at 2 centimeters depth, 1 centimeter depth and then empty, based on light emitted from infrared emitter 31.

Where a stainless steel ampule is employed, the appropriate liquid levels are obtained by inserted quartz rods. The length of these rods determine the start and stop levels in the stainless steel ampule. The position of the automatic refill line 19 permits the replacement chemical to enter the ampule 18 adjacent the bottom of the ampule at a point closest to the heating means and heat sink 55 on which the ampule 18 sits. This quickly warms the replacement chemical to the required temperature to preserve the required degree of carrier gas saturation by the chemical, as previously mentioned. The key in this process is the positioning of the automatic fill start point and stop point chemical level sensor means 25 and 26 so that only a relatively small volume of replacement chemical enters the ampule at one time. This permits the chemical to be continuously available so that the end process apparatus, for example the diffusion furnace 16 of FIG. 1, is constantly supplied with chemical saturated gas and can operate continuously.

Figure 3:
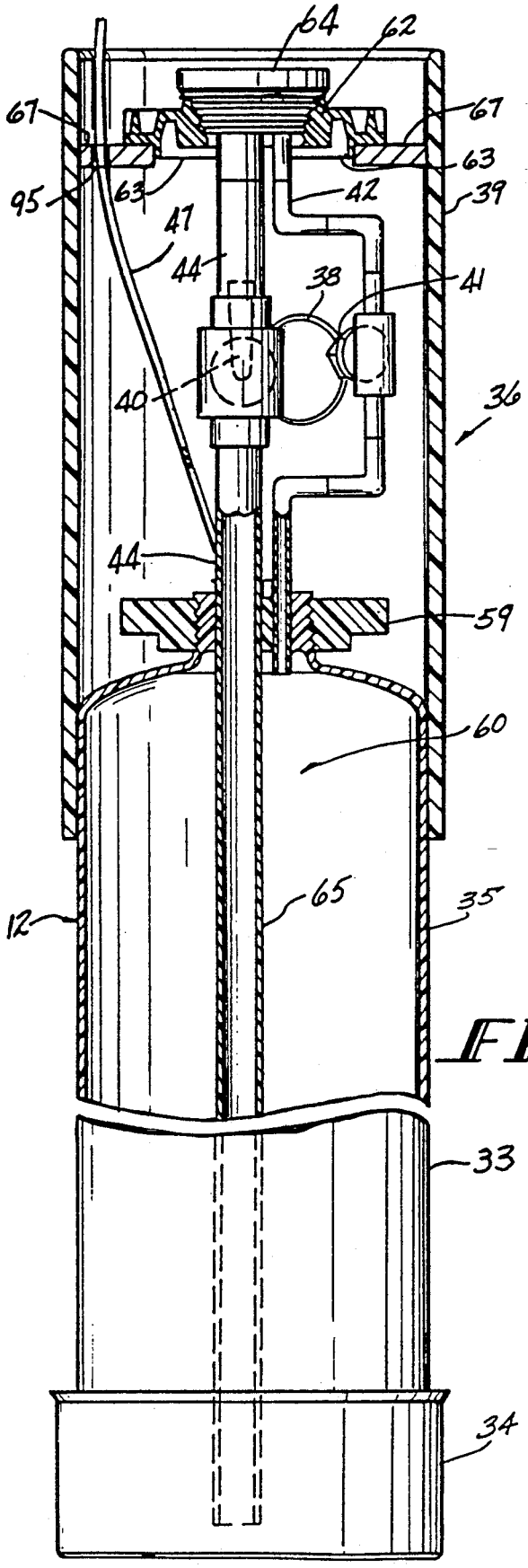
FIG. 3 is a side elevational view of the bulk container that provides the liquid chemical to the liquid chemical receiving ampule in the automatic refill system.

FIG. 3 shows the bulk supply chemical container 12 with a base section 34 to support the bottle container 33, a sidewall 35 that is preferably polytetrafluoroethylene, such as DuPont's TEFLON® PFA, or at least lined with this material, and a top bulk supply container connection apparatus or section, indicated generally by the numeral 36. The bottle container 33 is overwrapped with fiberglass rovings soaked in epoxy resin. An access port 38 is provided in the cap 39 of top section 36 to permit access to the valves 40 and 41. Valve 41 controls the flow of the inert gas, such as nitrogen, that is released into the container 12 through supply line 42 from a gas process supply line (not shown) to pressurize the system. This forces out the chemical into the liquid chemical output supply line 44 and the liquid chemical infeed line 17 of FIGS. 3 and 1, respectively, when the valve 40 is open. The inert gas supply line 42 is offset in an appropriate manner to permit both valves 40 and 41 to be reached through the access port 38.

Figure 5:
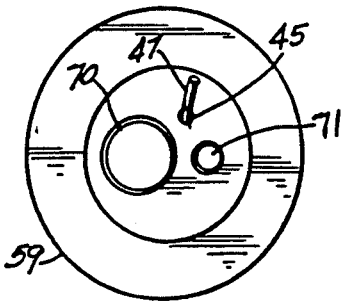
FIG. 5 is a top plan view of the top of the dip tube assembly as it fits in the bulk container showing the openings for the chemical, air and electrical lines.

The container 12, as seen in FIG. 3, has top closure 59 threaded into the top of bottle container 33 as part of the dip tube assembly, indicated generally by the numeral 60. Top closure 59, as seen briefly in FIG. 5, has three openings. Opening 70 is for the liquid chemical flow conduit or supply line 44, opening 71 is for the inert gas supply line 42 and conduit 45 holds the electrical wiring 47 (also seen in FIG. 4) for the depth sensor means 61 of FIG. 4. Conduit 45, located behind the liquid chemical supply line 44 in FIG. 3, supply line 44 and inert gas supply line 42 are made of DuPont's TEFLON® PFA plastic.

The top of tank cap 39 has a contamination minimizing seal that includes a support fitting 63, a threaded receiving portion 62 and a closure cap 64 that is removable from a suitable coupling (not shown) after shipping for connection to the liquid chemical infeed line 17, which feeds ampule or working container 18 in the controller 14. This connection is made through appropriate quick disconnect apparatus (not shown). Also, the inert gas supply line 42 is connected via an appropriate connection to the quick disconnect apparatus. Support fitting 63, receiving portion 62 and cap 64 in tank cap 39 are made of TEFLON(D PFA. Depth sensor wiring 47 has a suitable electrical coupling, such as a plug, that connects to the appropriate module 91 to provide warning when the liquid chemical level in bulk supply tank 12 is low. Wiring 47 passes out the support fitting via a through hole 95 in shelf 67. Support fitting 63 snaps into place against shelf 67, which extends out from tank cap 39.

The quick disconnect assembly (not shown) can be snap locked into place inside the aforementioned coupling and then secured by threading on a nut portion (not shown), after closure cap 64 is removed. This makes the appropriate connections for inert gas supply line 42 and liquid chemical supply line 44 to the aforementioned quick disconnect apparatus. 0-rings (not shown) and a spring loaded check valve (also not shown) may be employed in the base portion of the quick disconnect apparatus.

Figure 4:
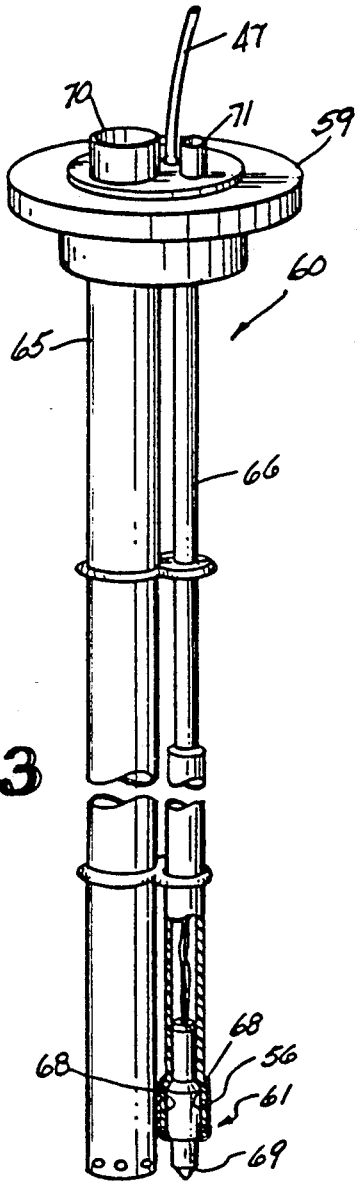
FIG. 4 is an enlarged side elevational view of the dip tube assembly that extends into the bulk container which can be used to sense the liquid chemical level and to permit the outflow of replenishing liquid chemical.

Dip tube assembly 60, seen in FIG. 4, has the liquid chemical supply line 44 of FIG. 3 connected to the down tube 65 to allow the liquid chemical to flow out of the supply container 12. The depth sensor means 61 is fitted and sealed within sensor tube 66. Sensor means 61 includes an appropriate block 68, such as aluminum, and a quartz prism 69. Shrink wrap material 56 seals the assembly 60 against moisture entering the tube 66. The sensor means 61 also has an appropriate light source and photoreceptor (both not shown) adjacent the prism 69 within the block 68 to sense the depth of the liquid chemical in bulk supply chemical container 12. Depth sensor means 61 is available from Kinematics and Controls Corporation of New York, N.Y. The dip tube assembly 60 and bulk supply chemical container 12 are available from Fluoroware Corporation of Chaska, Minn.

Figure 6:
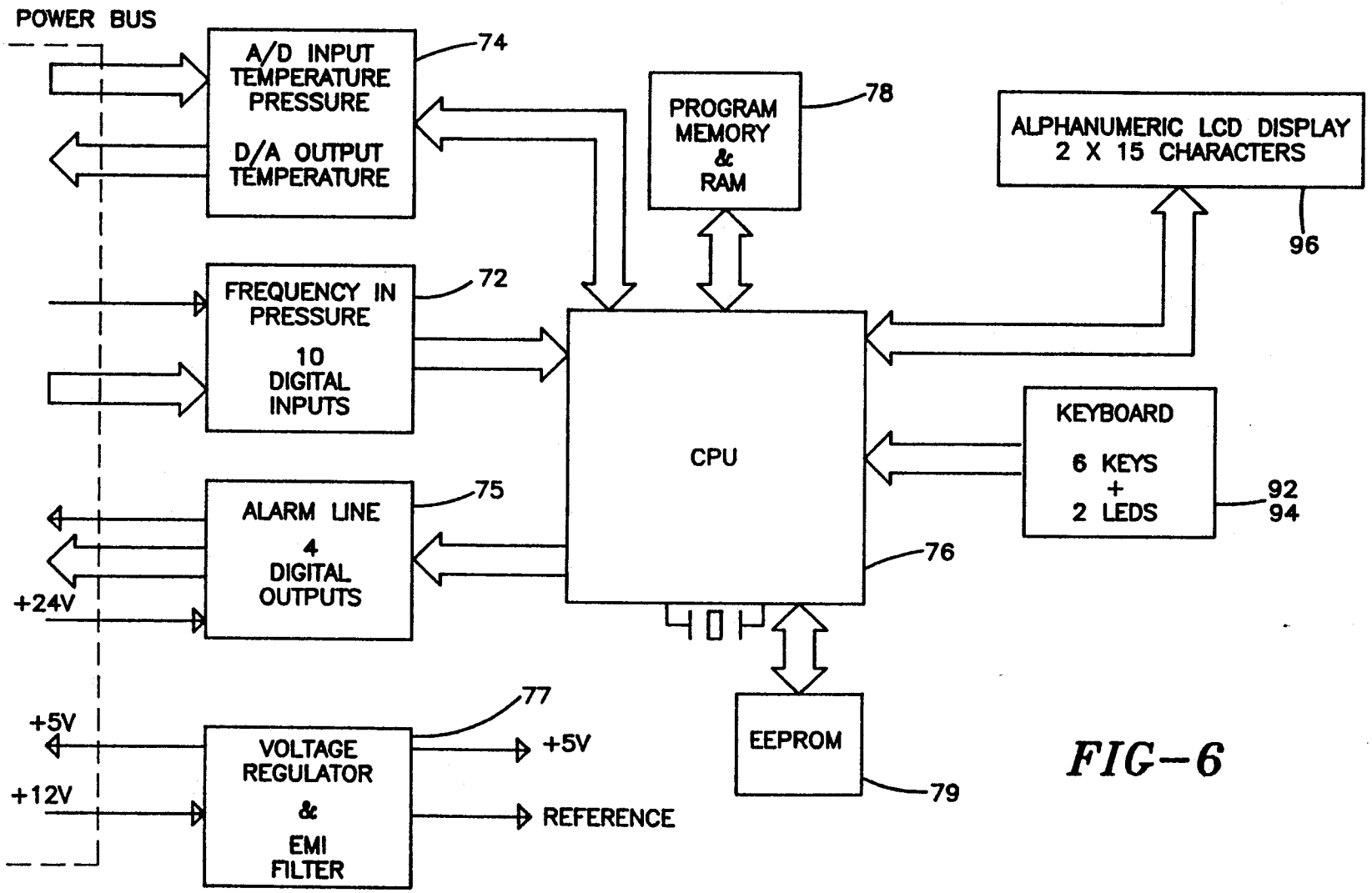
FIG. 6 is a block diagram indicating the logic circuitry flow path for the microprocessor within one microprocessor controlled unit module of the automatic refill system.

FIG. 6 is a block diagram illustrating the logic circuitry path of information and responses through the automatic refill system 10. It is to be understood that although the following description will deal only with a single liquid chemical temperature controller 14, the same automatic refill system 10 can be used with multiple liquid chemical temperature controllers, for example four, being refilled from the same or additional bulk supply containers 12. In this instance, each separate microprocessor module 91 employs the system 10 described hereinafter. At the center of the system 10 is controller 11 with its individual microprocessor controlled unit modules 91, which each individually initially receive input from an input module 72. This input comprises signals that are representative of the liquid chemical level in the ampule 18 and the liquid level in the bulk supply chemical container 12.

Another module 74 provides the analog input representative of the temperature of the chemical in the ampule 18 from the temperature sensing unit 23 of FIG. 2. The liquid chemical temperature setpoint for the ampule 18 in controller 14 is also fed into module 74. The temperature setpoint is set on the front panel of the microprocessor controlled unit module 91 by push buttons. Module 74 of FIG. 6 permits operator interface through the front operating panel 93 of the housing 90 of the controller 11.

The output modules from the controller 11 include module 74 and output module 75. Analog module 74 sends an output signal representative of the desired temperature setpoints that are set by the aforementioned digital push buttons for up to four temperature controllers 14 on the front operating panel 93 of the housing 90 of controller 11. This data goes to the temperature controller 14. Digital output data from module 75 goes to the front operating panel 93 of controller 11, as well as to the diffusion furnace 16 of FIG. 1.

Another output module (not shown) is used to respond to a signal from an individual microprocessor 76 of FIG. 6 in the microprocessor controlled unit module 91 to open or close the solenoid valves on the valve control manifold 15 of FIG. 1 from the bulk supply chemical container 12 to control the flow of replacement chemical to the ampule 18. Module 75 also controls the audio alarm and status lights in rows 92 and 94, respectively, of FIG. 8 on the front operating panel 93 of the individual microprocessor controlled unit module 91 in the housing 90 containing the microprocessor 76.

The front operating panel 93 can be fabricated with a front polyester or polycarbonate layer having the appropriate labelling thereon. It also includes 6 push button switches and 2 indicator light emitting diodes (LED's) in the alarm and status light rows 92 and 94, respectively. The audio alarm is a piezoceramic buzzer mounted behind panel 93 to produce a modulated sound level during alarm conditions.

A representative equipment list necessary to operate the automatic refill system 10 is given below.

Figure 7:
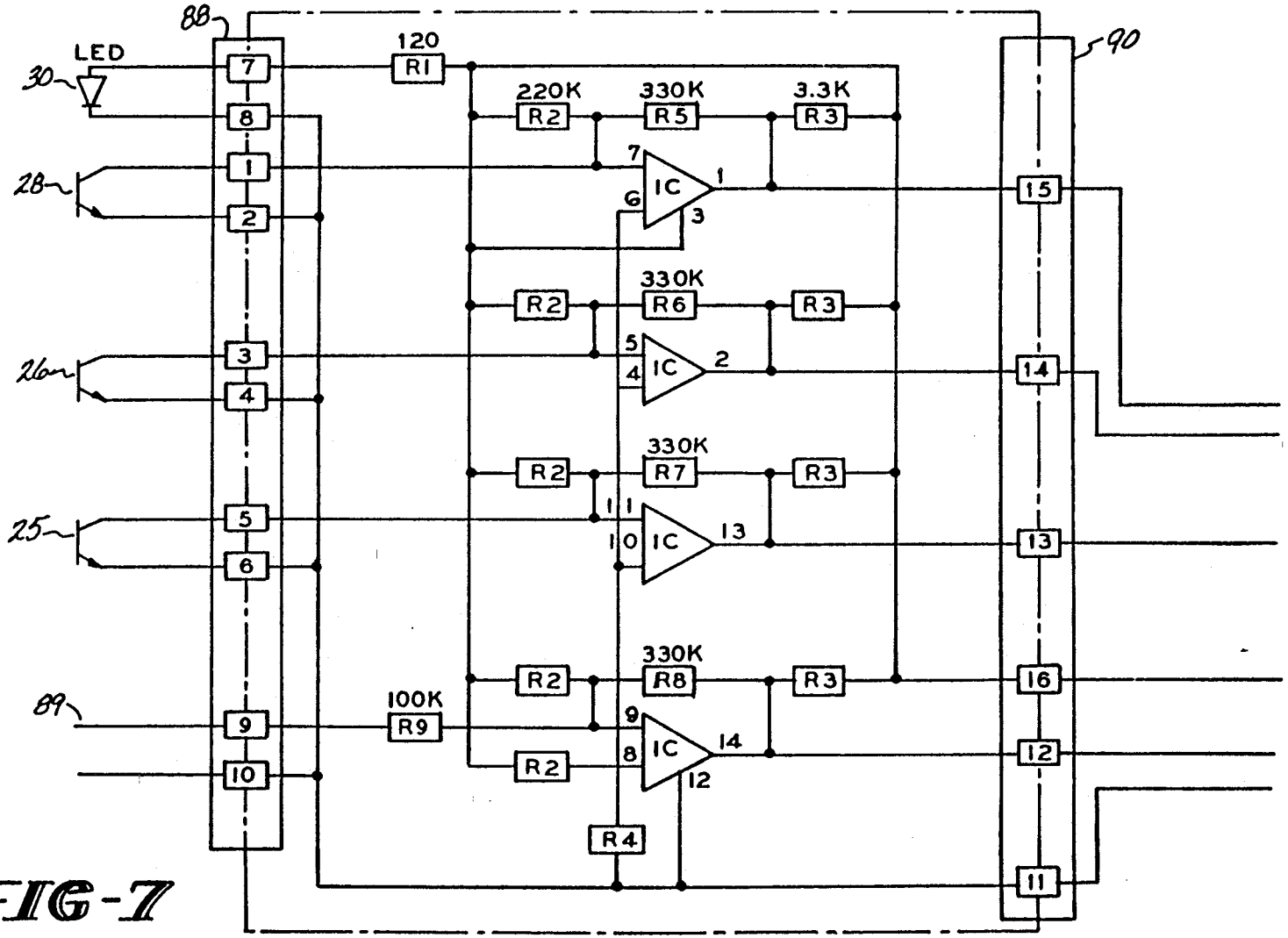
FIG. 7 is a circuit diagram of a preferred liquid level sensing circuit used to sense the liquid chemical in the liquid receiving ampule.

Apache model 775 I/O temperature controller internally modified for liquid level control and alarms with resistors and integrated circuits (LM 393 PC) and a 1500 cubic centimeter three-necked bubbler ampule MACE series 802 24 volt D.C., normally closed solenoid valves Fluoroware 20 liter PFA drum with level sensor General Electric Infrared Emitter Model LED 55BF General Electric Model L14F2 photodarlington FIG. 7 shows a preferred operational amplifier circuit used to sense the liquid level in the ampule 18 and to transmit signals representative of that liquid level to the microprocessor 11. The light source 30 emits light that is detected, depending upon the liquid level in the ampule 18, by the photodarlington sensor means 25, 26 or 28. This information is transmitted to the appropriate pin connection on the digital input circuitry 81. If the level of liquid is at the low level of sensor means 29 of FIG. 2, the alarm circuit of temperature controller 14 sends a signal that is fed into the digital input circuitry 81. Depending upon the signal sent, the input signals follow their appropriate circuit paths through resistors and operational amplifiers that together comprise the circuit which enhances the signal sent through module 81 to the micro processor 11. The signals are consolidated in a terminal board in the temperature controller 14 and sent to the module 81.

In operation the automatic refill system 10 functions by having the sensor means 25, 26, 28 or 29 send a signal, based upon the detection of internally reflected or refracted light within ampule 18 according to the basic principles of Snell's Law. The signal is received from module 81 by the microprocessor 11, which in turn sends a signal to the actuator means or solenoid valve manifold 15 to open the appropriate solenoid valve to permit replenishing liquid chemical from the bulk supply chemical container 12 flow to the ampule 18. When sensor means 20 senses the ampule 18 is full, a signal is sent that causes the individual microprocessor controlled unit module 91 to stop the flow of replenishing liquid chemical from the container 12 by shutting the appropriate solenoid valve in manifold 15.

The liquid chemical is kept at the desired temperature in ampule 18 by the input of the temperature setpoint from analog module 74 into the appropriate individual microprocessor controlled unit module 91. The temperature of the heating means and heat sink 55 is then adjusted within the liquid temperature controller 14. Signals representative of the actual temperature readings are sent back to the alphanumeric dot matrix liquid crystal display window 96 on the front operating panel 93 of the appropriate individual microprocessor controlled unit module 91 from the liquid temperature sensing unit 23 of FIG. 2 via analog input module 74. The temperature is also displayed on the front panel of the housing containing controller 11 of FIG. 2 via analog output module 74.

The depth of the chemical in the ampule 18 is closely monitored so that the ampule is continuously automatically refilled to avoid large volume, and the resulting temperature, fluctuations. In this manner a continuous supply of chemical saturated gas is supplied to the diffusion furnace 16. If the temperature or liquid level sensings vary from the acceptable range, alarms are initiated via the digital output module 75 of FIG. 6. Similarly, the level of replacement liquid chemical in the bulk supply chemical container 12 is monitored by the depth sensor means 61 of FIG. 4 and relayed to the microprocessor 76 by the digital input module 72 to signal when a replacement bulk supply chemical container 12 is necessary.

Figure 8:
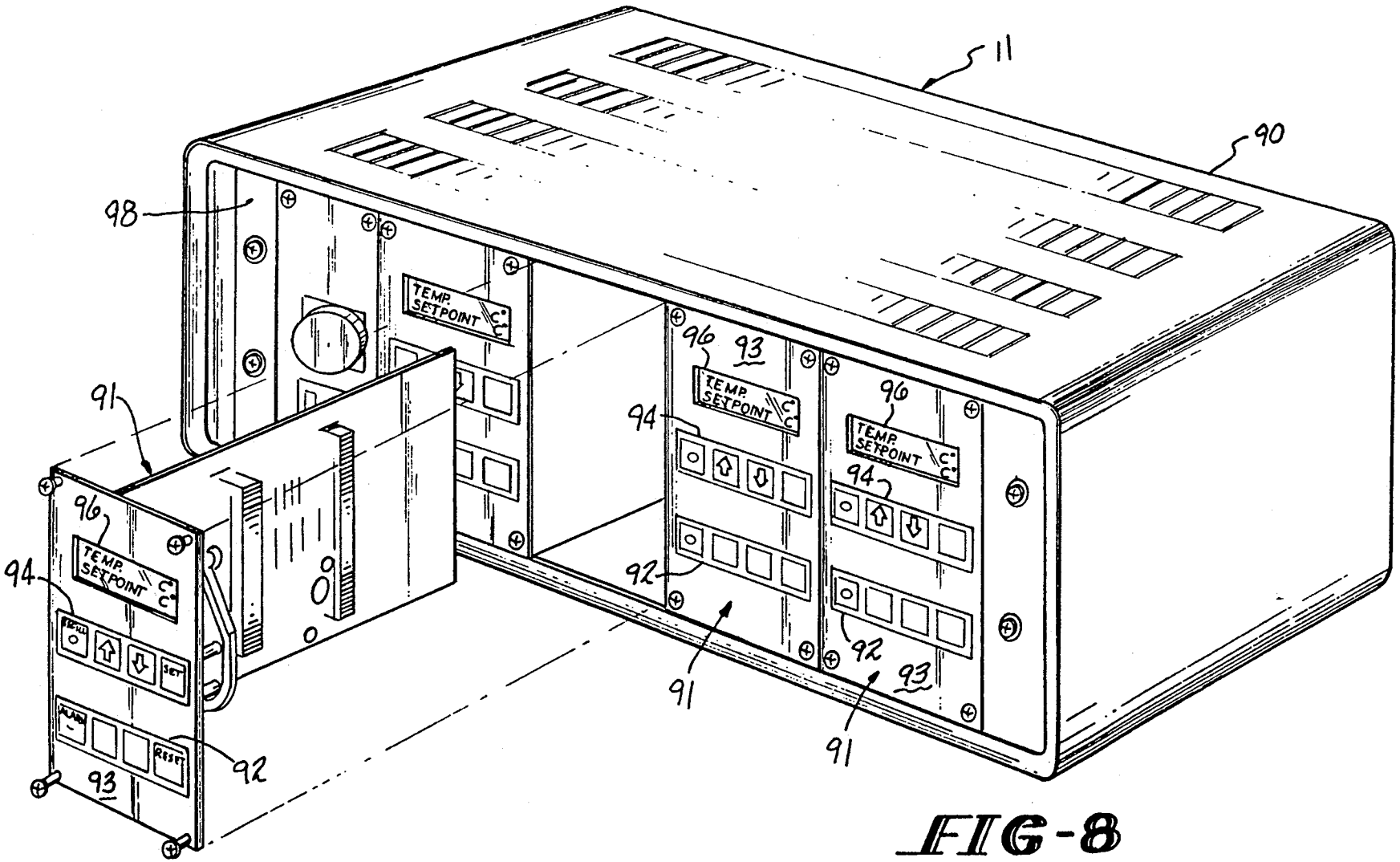
FIG. 8 is a front perspective view of the modular auto refill system with one control module removed to illustrate the ease of replacement of the microprocessor controlled module which controls the operation of one temperature controller.

The microprocessor controlled unit modules 91 fit into the housing 90 of FIG. 8 which is a standard 19 inch rack system. A single rack or housing 90 is able to accept one power supply unit module 98 and up to four individual microprocessor controlled unit modules 91. Each of the modules 91 are totally independent from each other, except in commonly shared alarm conditions, such as low level bulk alarms and operate in stand-alone fashion. An unlimited number of the microprocessor control units 11 can be connected or linked together to increase the number of temperature controllers and diffusion furnaces serviced.

The individual microprocessor controlled modules 91 monitor the liquid level and temperature in the temperature controller 14 and simultaneously control the level and pressure in the bulk supply chemical container or tank 12, as previously described. The number of individual microprocessor controlled modules 91 employed is a function of the number of temperature controllers 14 being utilized. Each microprocessor controlled unit module 91 provides the interface with the sensors and control signals going to and coming from the previously described peripheral equipment. Each module is based on a 80C552 CMOS single chip microprocessor 76 (see FIG. 6), together with an EPROM 78 for the program memory and a serial EEPROM 79 for permanent storage of the programmable parameters. Each individual microprocessor controlled module 91 is powered from the power supply module 98 of FIG. 8 available on the power bus. Each module 91 is regulated by a voltage regulator 77 of FIG. 6 to a stabilized +5 volts, and is protected from electromagnetic interference. The 12 volts input voltage is protected against reverse polarization.

The power supply unit module 98 is also a self-contained module that provides the power voltages and currents required to operate the four individual microprocessor controlled unit modules 91 in each automatic refill system housing 90. Connection with a main supply voltage is effected via a standard 3 pole male power cord connector on the rear of the power supply unit module 90 that is integrated with an electromagnetic interference filter and a selector switch for multiple voltage level operation, such as 110, 220, or 240 volts. The primary voltage inlet can be protected by a fuse. The power supply unit module 98 provides a 12 volt DC/1 ampere output voltage for the logic in the individual microprocessor controlled modules 91 and a 24 volt DC/2 ampere output voltage for the operation of valves 15 and other system peripherals. Both of these supply voltages are unstabilized and are derived from separate secondary windings of the transformer to obtain a galvanic isolation between the two voltages to avoid noise coupling. Consequently, each output voltage has its own ground. These output voltages are available at a pluggable 9 pole screw connector located at the rear of the unit.

The system 10 employs two analog outputs per microprocessor controlled module 91 delivering linear analog output voltages of 0–5 volts. The first is used with the temperature setpoint output to the temperature controller 14 and the second is used with the temperature output to the individual furnace computer (not shown). The system 10 also uses three analog inputs per microprocessor 11, accepting analog input signals of 0–5 volts. The first is the actual temperature input of the liquid chemical from the temperature controller 14. The second is the temperature setpoint input from the furnace computer (not shown). The last is the pressure input from the bulk supply chemical tank 12.

The microprocessor 10 within the individual modules 91 employs 10 digital inputs for the following functions:

Bulk supply chemical container low level signal
Ampule low level input
Ampule start level input
Ampule stop level input
Ampule high level input
Process busy input
Bulk supply chemical container connected
Ampule connected
Bulk supply chemical container low pressure switch
Bulk supply chemical container high pressure switch All of these digital inputs to the microprocessor controlled modules 91 are completely galvanically isolated to enhance reliability and are supplied by either the 24 voltage supply from the power supply unit module 98 or from the peripheral equipment.

The microprocessor 11 within the individual modules 91 employs 4 digital outputs for the solenoid valves in manifold 15 controlling the flow of chemical from the bulk supply chemical container 12, an auxiliary alarm output, a refill busy output to signal when the bulk supply chemical container 12 is in use refilling an ampule 18 in one of the temperature controllers 14 within the system 10, and a microprocessor controlled unit module 91 alarm to diffusion furnace output. The solenoid valve digital output and the auxiliary alarm output deliver a 24 volt output voltage when active. The refill busy and the microprocessor controlled unit module 91 alarm to diffusion furnace outputs deliver either a 24 volt or a 5 volt output when active. The solenoid valve digital output further uses an internal feedback control to monitor the operation for failsafe operation in a series connection with a relay that turns off in case of valve operation failure to disconnect the 24 volt supply.

The alarm condition sensing system employs a bidirectional input/output port that is connected electrically in parallel with the alarm contacts of the individual microprocessor controlled modules 91. The output section is designed as an open collector output with a weak internal pull-up resistor. In non-alarm conditions this alarm line retains a high voltage level of about 12 volts. However, when a bulk supply container 12 alarm condition is sensed the voltage through the alarm line is lowered by the microprocessor controlled unit module 91 that detected the condition. This in turn is detected by the other microprocessor controlled unit modules 91 in the system so they may respond accordingly and not attempt to refill. The audial alarm is sounded by the appropriate microprocessor controlled unit 91 and remains activated until reset or acknowledged.

While the preferred structure in which the principles of the present invention have been incorporated is shown and described above, it is to be understood that the invention is not to be limited to the particular details thus presented, but in fact, widely different means may be employed in the practice of the broader aspects of the invention. For example, the low level sensor means could activate an automatic emergency fill cycle to automatically initiate an emergency filling of the ampule. Similarly, instead of using separate sensor means for the automatic fill start point and automatic fill stop point chemical level sensors, a single sensor could be used to accomplish both functions. It is to be understood, also, that the bulk supply chemical container could be stainless steel, as could the ampule within the liquid chemical temperature controller. In the latter case the liquid level sensor means could be inserted within the ampule.

The scope of the appended claims is intended to encompass all obvious changes in the details, materials, and arrangement of parts which will occur to one of skill in the art upon reading the disclosure.

What is claimed is:

1. A modular automatic liquid chemical refill system comprising:

(a) a plurality of working containers for receiving and retaining a liquid chemical and dispensing a vapor made from said liquid chemical; each working container having associated with it at least one liquid leveling sensor and at least one liquid temperature sensor;

(b) a corresponding plurality of temperature controllers wherein each working container is located within a temperature controller, each temperature controller capable of maintaining the temperature of the liquid chemical within the corresponding working container at a preselected temperature;

(c) a bulk chemical supply container capable of containing said liquid chemical, said bulk chemical supply container equipped with a sensor for measuring either the pressure or liquid level or both in said bulk chemical supply container;

(d) an actuator means capable of controlling the flow of said liquid chemical from said bulk chemical supply container to said plurality of said working containers;

(e) a first conduit means for transferring said liquid chemical from said bulk chemical supply container to said actuator means;

(f) a plurality of second conduit means, each second conduit means for transferring said liquid chemical from said actuator means to a working container;

(g) a plurality of third conduit means, each third conduit means for transferring an inert carrier gas into a working container;

(h) a plurality of fourth conduit means, each fourth conduit means capable of transferring a vapor mixture of vaporized liquid chemical and inert carrier gas from a working container to an end use apparatus;

(i) a modular automatic refill controller containing a plurality of independently operating microprocessor-controlled modules, each module being matched electrically in a one-to-one correspondence to a working container, said bulk chemical supply container, and said actuator and programmed to control the refilling operation of said corresponding working container from said bulk chemical supply container and monitor the liquid level and temperature within said corresponding working container and the liquid level or pressure or both in said bulk chemical supply container; wherein each independently operating microprocessor-controlled module may be removed from the modular automatic controller without interrupting the operation of the remaining microprocessor-controlled modules and their corresponding working containers and temperature controllers and wherein each microprocessor-controlled module, upon sensing an alarm condition from a liquid level or liquid temperature sensor from its corresponding working container may cause either a refill of that working container or a shut down of that automatic refill line, and wherein all microprocessor-controlled modules, upon sensing a low level or low pressure alarm condition from said sensor in the bulk chemical supply container, will act synchronously to cease operation from that bulk chemical supply container.

2. The refill system of claim 1 wherein said actuator means is solenoid valves on a valve control manifold.

3. The refill system of claim 1 wherein said end use apparatus is a diffusion furnace.

* * * * *